US006484704B2

(12) United States Patent
Cook et al.

(10) Patent No.: US 6,484,704 B2
(45) Date of Patent: Nov. 26, 2002

(54) ROTARY VALVE ACTUATING SYSTEM

(75) Inventors: John Edward Cook; Cristian Tofan-Petre, both of Chatham (CA)

(73) Assignee: Siemens Canada Limited (CA)

( * ) Notice: Subject to any disclaimer, the term of this patent is extended or adjusted under 35 U.S.C. 154(b) by 18 days.

(21) Appl. No.: 09/785,515

(22) Filed: Feb. 20, 2001

(65) Prior Publication Data

US 2001/0032632 A1 Oct. 25, 2001

Related U.S. Application Data

(60) Provisional application No. 60/183,456, filed on Feb. 18, 2000.

(51) Int. Cl.[7] ..... F02M 25/07

(52) U.S. Cl. ..... 123/568.16; 123/568.23

(58) Field of Search ..... 123/568.16, 568.24, 123/568.23

(56) References Cited

U.S. PATENT DOCUMENTS 4,378,776 A * 4/1983 Nishimori ..... 123/568.16
5,474,051 A * 12/1995 Matsumoto et al. ... 123/568.16
5,531,205 A 7/1996 Cook et al. ..... 123/568
5,606,957 A * 3/1997 Feucht ..... 123/568.23
5,771,869 A * 6/1998 Yoshihara et al. ..... 123/568.16
6,000,385 A * 12/1999 Fukuma ..... 123/568.16
6,012,437 A * 1/2000 Radhamohan et al. . 123/568.23
6,182,645 B1 * 2/2001 Tsuchiya ..... 123/568.23
6,253,748 B1 * 7/2001 Engel et al. ..... 123/568.16

* cited by examiner

*Primary Examiner*—Paul J. Hirsch

(57) ABSTRACT

A system and a method for recirculating a flow of exhaust gases. The system comprises a passage through which the exhaust gas flow passes, a valve movable in the passage between a generally open configuration and a generally closed configuration, an actuator operatively connected to the valve, and a fail-safe returning the valve to one of the generally open and generally closed configurations if the actuator is disabled. The generally open configuration of the valve substantially permits the exhaust gas flow to pass through the passage, and the generally closed configuration of the valve substantially prevents the exhaust gas flow from passing through the passage. The actuator includes a one-way driver and a release to move the valve between the generally open and generally closed configurations and to vary the exhaust gas flow though the passage. The method comprises energizing the actuator with a power supply, and moving the valve to a fail-safe position if the power supply fails.

16 Claims, 4 Drawing Sheets

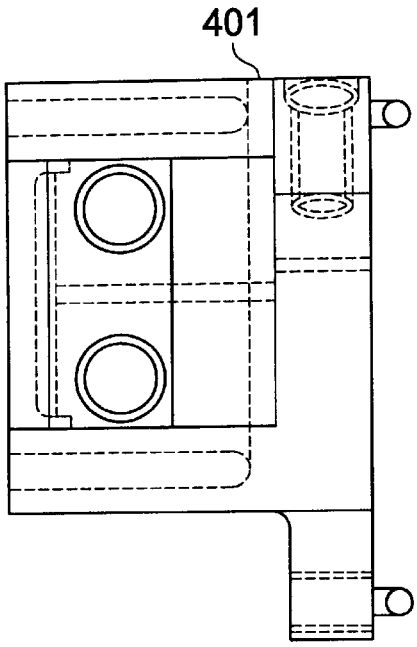
FIG.4a
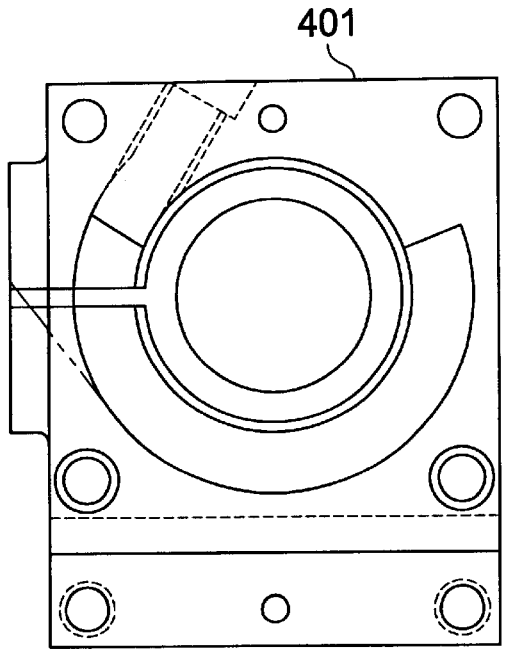
FIG.4b
FIG.4c
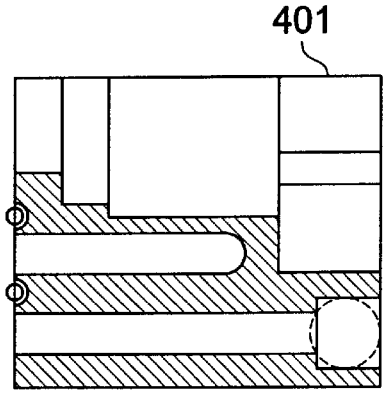
FIG.4d
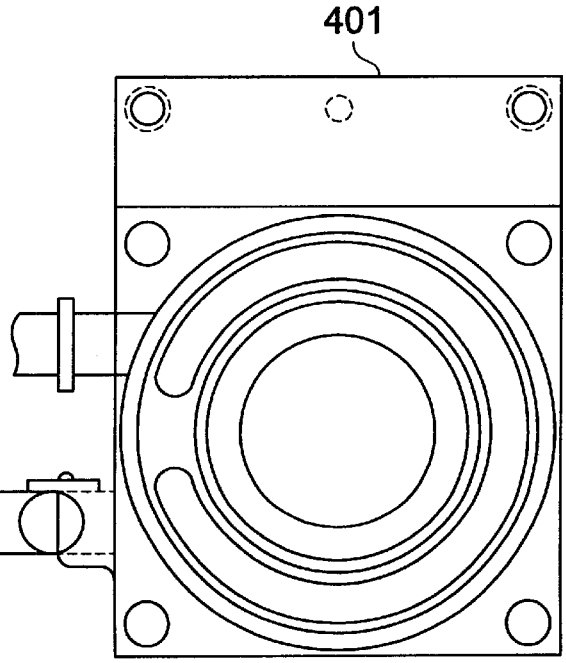

ROTARY VALVE ACTUATING SYSTEM

This application claims the benefit of U.S. Provisional application No. 60/183,456, filed Feb. 18, 2000.

BACKGROUND OF THE INVENTION

It is believed that known exhaust gas recirculation (EGR) systems include a valve connected to an actuator for controlling exhaust gas flow though the EGR systems. It is believed that these know EGR systems have a number of disadvantages including constantly energizing the actuator to maintain a current level associated with holding the valve in various states, and internal heat build-up caused by being constantly energized. It is believed that another disadvantage of these known EGR systems is the absence of a fail safe provision or the need for an H-bridge. However, it is believed that H-bridges typically do not provide the necessary speed desired for fail safe operation. Finally, it is believed that the known systems are too complex and therefore less reliable.

Thus, it is believed that there is a need for a simple EGR system including a fail safe provision.

SUMMARY OF THE INVENTION

The present invention provides a system for recirculating a flow of exhaust gases. The system comprises a passage through which the exhaust gas flow passes, a valve movable in the passage between a generally open configuration and a generally closed configuration, an actuator operatively connected to the valve, and a fail-safe returning the valve to one of the generally open and generally closed configurations if the actuator is disabled. The generally open configuration of the valve substantially permits the exhaust gas flow to pass through the passage, and the generally closed configuration of the valve substantially prevents the exhaust gas flow from passing through the passage. The actuator includes a one-way driver and a release to move the valve between the generally open and generally closed configurations and to vary the exhaust gas flow though the passage.

The present invention also provides a method for recirculating a flow of exhaust gas through a passage. A valve is disposed in the passage and is movable by an actuator between a generally open configuration and a generally closed configuration. The generally open configuration of the valve substantially permits the exhaust gas flow to pass through the passage, and the generally closed configuration of the valve substantially preventing the exhaust gas flow to pass through the passage. The method comprises energizing the actuator with a power supply, and moving the valve to a fail-safe position if the power supply fails. The actuator includes a one-way driver and a release. The one-way driver moves the valve toward a first one of the open and closed configurations, and the release allows the valve to be moved toward a second one of the open and closed configurations. The energizing the actuator varies the exhaust gas flow through the valve. And the fail-safe position permits a fail-safe flow of the exhaust gas flow to pass through the passage.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of the invention in accordance with a best mode contemplated for carrying out the invention.

FIGS. 4*a*–4*d* illustrate a cooling block for a rotary valve actuating system.

DESCRIPTION OF THE PREFERRED EMBODIMENT

Figure 1:
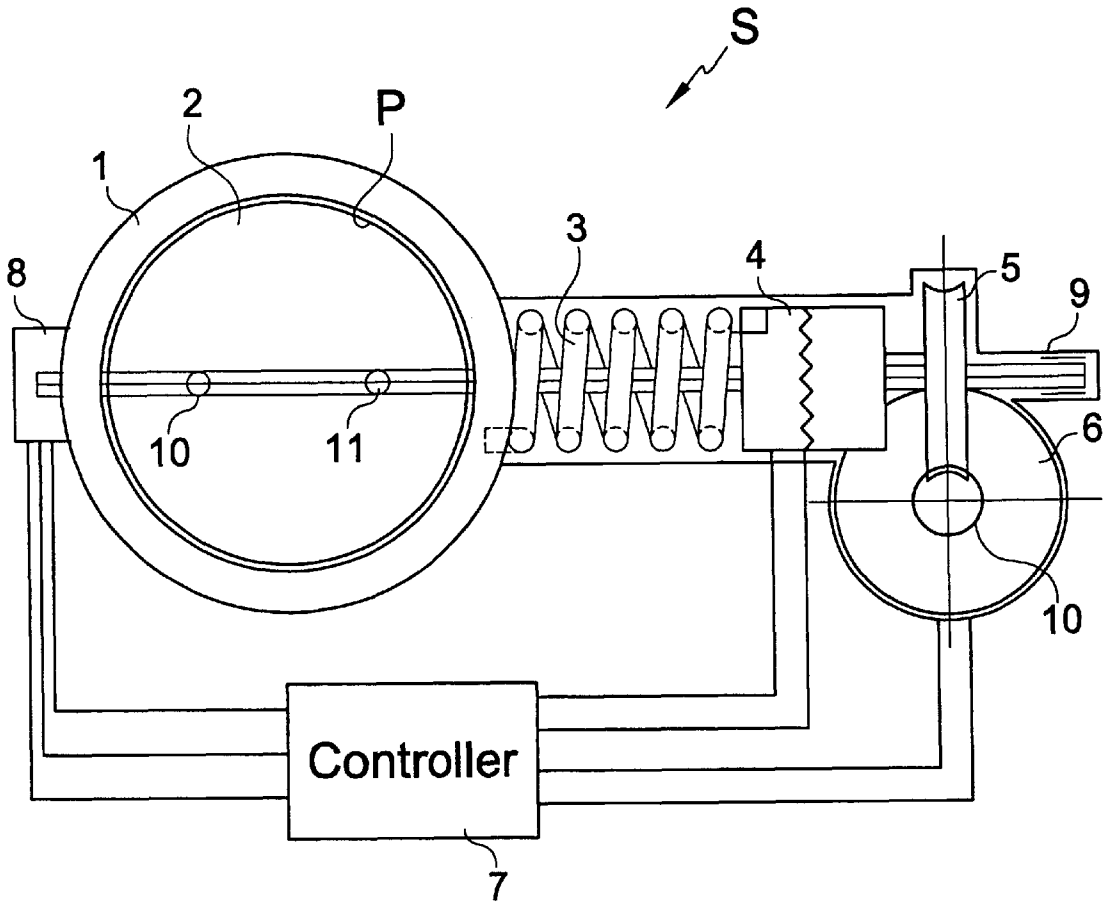
FIG. 1 is a schematic diagram of a rotary valve actuating system.

Reference will now be made in detail to an embodiment of a rotary valve actuating system S. Wherever possible, the same reference numbers will be used throughout the drawings to refer to the same or like parts.

Referring to all of the figures, the system S includes a housing 1 defining a passage P. A valve blade 2 is fixed on a shaft 9 by two fasteners 10,11 (e.g., bolts, screws, or an equivalent), and the shaft 9 is mounted in the passage P for relative rotation with respect to the housing 1. A biasing member 3, which can be a torsion spring, is attached to the housing 1 and to a release mechanism 4, which can be an electric clutch or an equivalent. Actuating the shaft 9 is a one-way driver, such as a worm gear set including a worm wheel 5 engaging a worm 10. The worm 10 is rotated by an electric motor 6 or some other equivalent prime mover, and the worm wheel 5 rotates the shaft 9. Attached to the shaft 9 is a position sensor 7 that can be used to inform the controller 8 about the degree of shaft rotation, which can be correlated with the flow conditions through the passage P by the controller 8.

An example of operating the system S will now be described. The controller 7 energizes the electric motor 6 so as to turn, via the one-way driver and the shaft 9, the valve blade 2 toward an open configuration with respect to the passage P. As the valve blade 2 is turned toward the open configuration, the flow of exhaust gas through the passage P can be varied. To turn the valve blade 2 toward the closed configuration with respect to the passage P, the release mechanism 4 is utilized. The release mechanism 4, which can include an electrically actuated clutch, releases the shaft 9 from the one-way driver such that the biasing member 3 turns the valve blade 2 via the shaft 9. By momentary releasing of the release mechanism 4, e.g., by the controller momentarily de-energizing the electric clutch, the valve blade 2 can be "stepped" toward the closed position. This momentary releasing can be repeated until the desired degree of exhaust gas flow through the passage P is achieved. The sensor 8 provides a feedback signal to the controller 7 so the position of the valve blade 2 maybe continuously monitored and adjusted.

Figure 2:
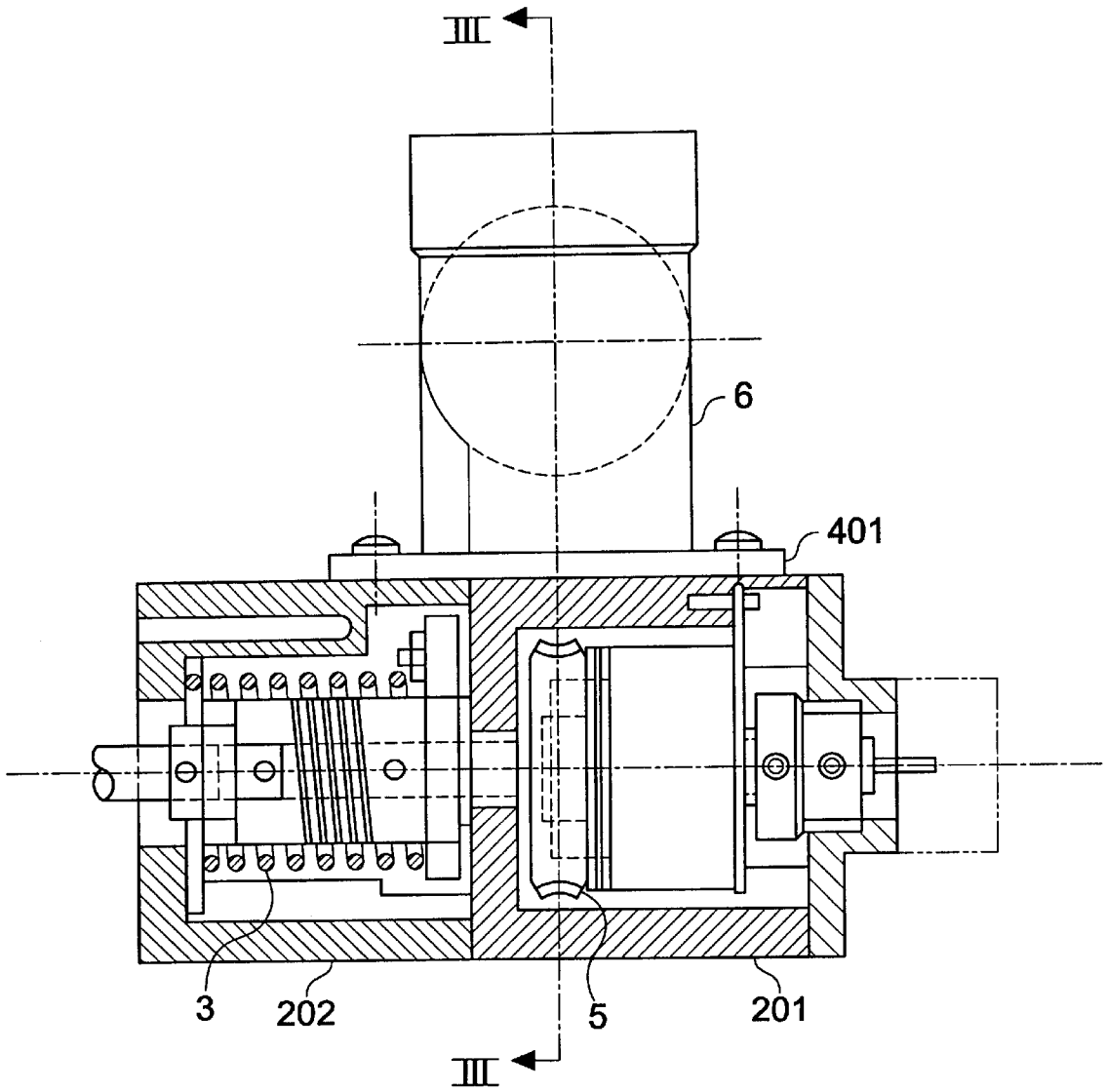
FIG. 2 is a section view of an embodiment of a rotary valve actuating system.

Referring particularly to FIG. 2, the housing 1 can include a first housing section 201 and a second housing section 202. The first housing section 201 generally supports the worm 10 and the worm wheel 5 fixed to the shaft 9. The second housing section 202 generally supports the biasing member 3. The motor 6 is secured to the housing sections 201 and 202 by a motor flange 401.

Figure 3:
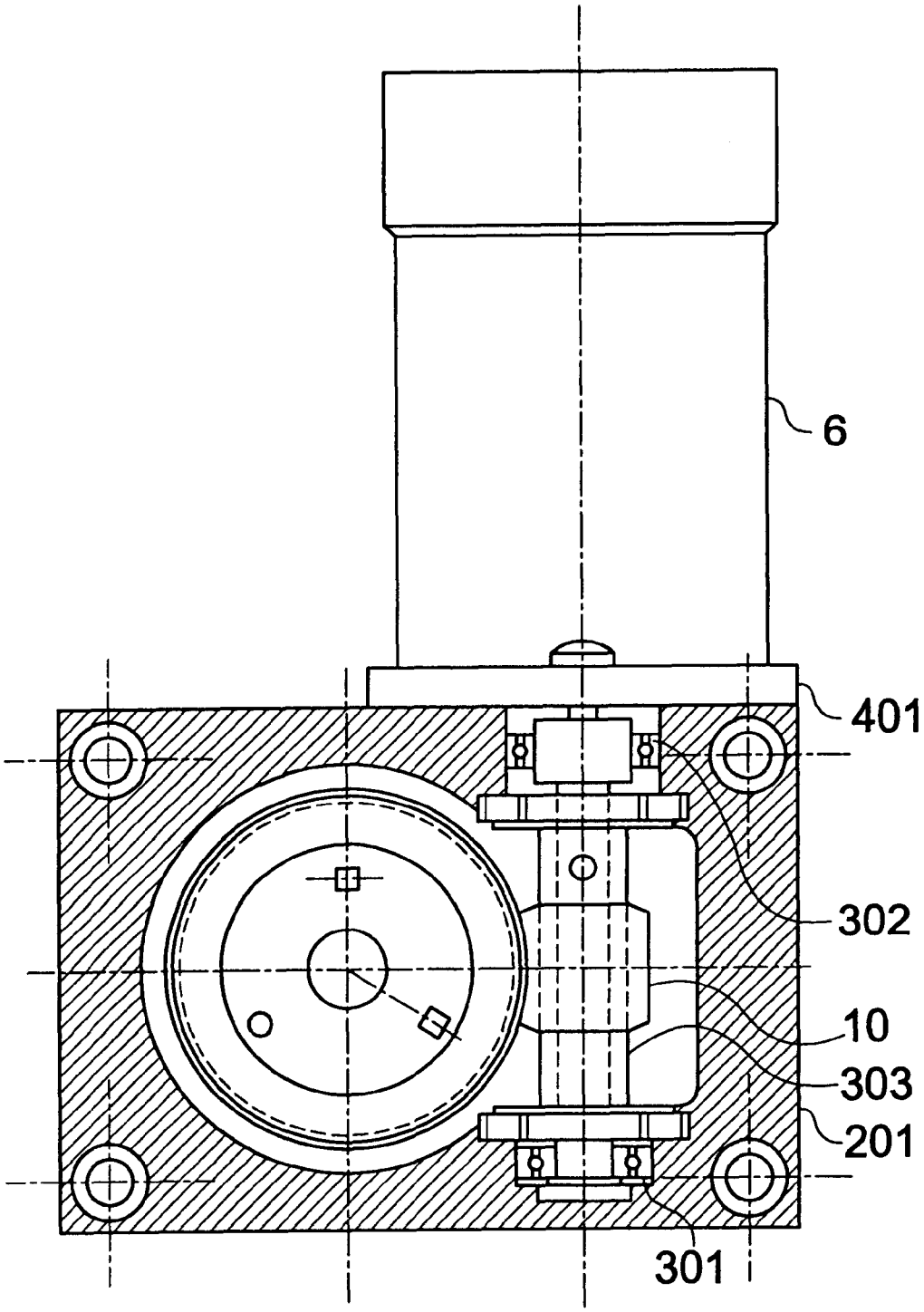
FIG. 3 is a section view taken along ling III—III in FIG. 2.

Referring particularly to FIG. 3, motor 6 is again shown secured to the housing sections 201 and 202 by the motor flange 401. Also shown is a motor shaft 303 supported on motor shaft support bearings 301 and 302. The motor shaft 303 is driven by the motor 6 and is fixed to the worm 10.

Referring particularly to FIGS. 4*a*–4*d*, a cooling block 401 can be used to extract heat, e.g., due to exhaust gas flow passing through the passage P, from the housing 1. Nipples 402 can be connected to a source of cooling fluid that can be circulated in the cooling block 401.

The motor 6 according to the system S can include a direct-current (DC) electric motor, an electric stepper motor, etc. Upon receiving an electric command signal from a controller, the electrical actuator is energized and moves the blade/shaft assembly to a displaced position. Another electrical signal engages the clutch such that rotation of the one-way driver is transmitted through the shaft to the blade. Alternatively, the clutch could be arranged so as to require an electrical signal to disengage the clutch. The sensor located on the end of the shaft that is opposite from the actuator can provide feedback to the controller. As soon as the blade/shaft assembly reaches the displaced position, the one-way driver is de-energized. Based on a proper ratio in the worm-gear transmission, the return spring on the blade/shaft, although opposing the forward motion of the electrical actuator, cannot return the shaft to its original position as long as the clutch is engaged.

If the blade/shaft assembly is moved beyond the displaced position, e.g., the forward motion of the electrical actuator overshoots the displaced position, or reversing the blade/shaft motion is desired, the clutch can be momentarily released one or more times, thereby allowing the blade/shaft to "step" backwards under the bias of the return spring. If there is a failure of the electric power supply for the one-way driver and the clutch, the blade/shaft returns to the original position, which generally corresponds to one of the open or closed positions of the blade in the throttle, depending on the application.

The system S provides a number of advantages including reducing the number of parts required to control an EGR systems (i.e., providing a simpler EGR system), reducing the required current and the associated internal heat build-up, and eliminating an H-bridge to improve the speed and reliability of the fail safe provisions of the system S. According to embodiments of the system S, the fail-safe position can be reached faster because less parts have to be moved by the return spring.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A system for recirculating a flow of exhaust gas, the system comprising:

a passage through which the exhaust gas flow passes, a valve movable in the passage between a generally open configuration and a generally closed configuration, the generally open configuration of the valve substantially permitting the exhaust gas flow to pass through the passage, and the generally closed configuration of the valve substantially preventing the exhaust gas flow to pass through the passage;

an actuator operatively connected to the valve, the actuator including a one-way driver and a release to move the valve between the generally open and generally closed configurations and to vary the exhaust gas flow though the passage; and a fail-safe returning the valve to one of the generally open and generally closed configurations if the actuator is disabled.

2. The system according to claim 1, wherein the fail-safe comprises a spring biasing the valve toward the one of the generally open and generally closed configurations.

3. The system according to claim 2, wherein the spring biases the valve toward the generally open configuration.

4. The system according to claim 1, further comprising:

a power supply, and a controller operatively connecting the one-way driver and the release to the power supply.

5. The system according to claim 4, further comprising:

a sensor operatively connected to the controller and the valve blade, the sensor providing a feedback signal to the controller when the valve moves between the generally open configuration and the generally closed configuration.

6. The system according to claim 4, wherein the one-way driver comprises a retainer and a motor, the retainer maintaining the valve configuration when the controller de-energizes the motor.

7. The system according to claim 6, wherein the retainer comprises gearing that resists back-driving.

8. The system according to claim 6, wherein the retainer comprises a worm operatively engaging a worm wheel, the worm being rotated by the motor and the worm wheel being connected for rotation with the valve blade.

9. The system according to claim 4, wherein the release comprises a clutch controlled by the controller.

10. A method for recirculating a flow of exhaust gas through a passage, a valve is disposed in the passage and is movable by an actuator between a generally open configuration and a generally closed configuration, the generally open configuration of the valve substantially permitting the exhaust gas flow to pass through the passage, and the generally closed configuration of the valve substantially preventing the exhaust gas flow to pass through the passage, the method comprising:

energizing the actuator with a power supply, the actuator including a one-way driver and a release, the one-way driver moving the valve toward a first one of the open and closed configurations, and the release allowing the valve to be moved toward a second one of the open and closed configurations, the energizing the actuator varying the exhaust gas flow through the valve; and moving the valve to a fail-safe position if the power supply fails, the fail-safe position permitting a fail-safe flow of the exhaust gas flow to pass through the passage.

11. The method according to claim 10, further comprising:

controlling the energizing with a controller, the controller commanding the actuator to move the valve between the open and closed configurations.

12. The method according to claim 11, further comprising:

feeding back a configuration signal from a sensor on the valve to the controller.

13. The method according to claim 10, wherein the moving the valve to the fail-safe position comprises biasing with a return spring.

14. The method according to claim 10, further comprising:

retaining the valve at a desired position with gearing that resists back driving, the retaining including de-energizing the one-way driver when the valve is in the desired position.

15. The method according to claim 10, wherein the moving the valve to the fail-safe position comprises de-energizing the release and applying a biasing force to the valve, the release includes an electric clutch and a spring supplies the biasing force.

16. The method according to claim 15, wherein the de-energizing comprises momentarily releasing the clutch repeatedly, and the applying the biasing force comprises stepping the valve toward the fail-safe position.

* * * * *